US010562089B2

(12) United States Patent
Suzuki et al.

(10) Patent No.: US 10,562,089 B2
(45) Date of Patent: Feb. 18, 2020

(54) HOT PRESS MACHINE, HOT PRESS METHOD, AND METHOD OF MANUFACTURING VEHICLE BODY COMPONENT

(71) Applicant: TOA Industries Co., Ltd., Ota-shi, Gunma (JP)

(72) Inventors: Yasutaka Suzuki, Ota (JP); Tadashi Iwanuma, Isesaki (JP); Satoshi Mizushina, Isesaki (JP)

(73) Assignee: TOA Industries Co., Ltd., Ota-shi (JP)

( * ) Notice: Subject to any disclaimer, the term of this patent is extended or adjusted under 35 U.S.C. 154(b) by 294 days.

(21) Appl. No.: 15/642,990

(22) Filed: Jul. 6, 2017

(65) Prior Publication Data

US 2018/0021833 A1 Jan. 25, 2018

(30) Foreign Application Priority Data

Jul. 19, 2016 (JP) ..... 2016-141472

(51) Int. Cl.

*B21D 37/16* (2006.01)
*B21D 22/02* (2006.01)
*B21D 39/03* (2006.01)

(52) U.S. Cl.

CPC ..... *B21D 22/022* (2013.01); *B21D 37/16* (2013.01); *B21D 39/031* (2013.01)

(58) Field of Classification Search

CPC ..... B21D 22/022; B21D 24/16; B21D 37/16; B21D 39/031

See application file for complete search history.

(56) References Cited

U.S. PATENT DOCUMENTS

| | | | | |
|---|---|---|---|---|
| 9,061,341 | B2 * | 6/2015 | Kobayashi | B21D 22/208 |
| 2007/0017272 | A1 | 1/2007 | Kurisu et al. | |
| 2012/0186705 | A1 | 7/2012 | Sikora et al. | |
| 2014/0239672 | A1 * | 8/2014 | Yajima | B62D 25/04 296/193.06 |

FOREIGN PATENT DOCUMENTS

| | | |
|---|---|---|
| JP | 8-103826 | 4/1996 |
| JP | 2002-282951 | 10/2002 |
| JP | 2005-169394 | 6/2005 |
| JP | 2014-193712 | 10/2014 |
| JP | 2015-226936 | 12/2015 |

OTHER PUBLICATIONS

Office Action dated May 7, 2018 directed to JP Application No. 2016-141472, 2 pages.

* cited by examiner

*Primary Examiner* — Debra M Sullivan
(74) *Attorney, Agent, or Firm* — Morrison & Foerster LLP

(57) ABSTRACT

The invention provides a hot press machine which reduces the cooling time of a superposed member and enhances the productivity. A hot press machine of the invention includes a first die, a second die disposed on the first die, a first refrigerant flow passage for guiding a refrigerant into the first die or the second die, a plurality of grooves formed in a press forming surface of the first die or the second die, and a second refrigerant flow passage for guiding a refrigerant into the grooves. The hot press machine performs press forming and quenching by pressing a superposed member between the first die and the second die, the superposed member comprising a first steel sheet and a second steel sheet superposed and joined on the first steel sheet.

9 Claims, 6 Drawing Sheets

HOT PRESS MACHINE, HOT PRESS METHOD, AND METHOD OF MANUFACTURING VEHICLE BODY COMPONENT

CROSS-REFERENCE OF THE INVENTION

This application claims priority from Japanese Patent Application No. 2016-141472, filed Jul. 19, 2016, the content of which is incorporated herein by reference in its entirety.

BACKGROUND OF THE INVENTION

Field of the Invention

The invention relates to a hot press machine for hot pressing a superposed member, a hot press method, and a method of manufacturing a vehicle body component using hot press.

Description of the Related Art

In general, hot press forming is to heat a steel sheet to a temperature which is at a transformation point for austenitizing or higher (e.g. 900° C.) and press the steel sheet between two dies disposed facing in a vertical direction, thereby press forming the steel sheet and simultaneously hardening the steel sheet by transforming the metal structure of the steel sheet from an austenite structure to a martensite structure by rapidly quenching with the dies.

Japanese Patent Application Publication No. 2014-193712 describes enhancing the mechanical strength of a vehicle body component such as a pillar reinforcement (a component forming a vehicle body) partially by forming a superposed member by superposing a plurality of steel sheets partially and then joining these by spot welding, and by hot press forming this superposed member. It is noted that the superposed member is also called "a patchwork".

However, a superposed portion of the superposed member has larger heat capacity (per unit area) than a portion other than the superposed portion (hereafter, referred to as an unsuperposed portion), and thus the cooling speed with dies is relatively lower.

Therefore, when a superposed portion of a superposed member has large thickness, this portion is not fully quenched, thereby causing a problem of difficulty in completing hot press forming itself.

Furthermore, even when hot press forming is completed, non-uniform cooling (a temperature difference between a superposed portion and an unsuperposed portion) causes a problem of degrading the uniformity of the quenching quality and degrading the size accuracy of the superposed member after hot press forming.

Furthermore, it takes a long time to cool all the superposed member to a target temperature for quenching (e.g. 200° C.), thereby reducing the productivity of hot press forming.

SUMMARY OF THE INVENTION

A hot press machine of the invention includes a first die, a second die disposed on the first die, a first refrigerant flow passage for guiding a refrigerant into the first die or the second die, a plurality of grooves formed in a press forming surface of the first die or the second die, and a second refrigerant flow passage for guiding a refrigerant into the grooves. The hot press machine performs press forming and quenching by pressing a superposed member between the first die and the second die, the superposed member comprising a first steel sheet and a second steel sheet superposed and joined on the first steel sheet.

A hot press method of the invention includes a first step forming a superposed member by superposing and joining a second steel sheet on a first steel sheet, a second step heating the superposed member, and a third step performing press forming and quenching by pressing the heated superposed member between a first die and a second die and bringing a refrigerant into direct contact with a superposed portion of the superposed member.

A method of manufacturing a vehicle body component of the invention includes a first step forming a superposed member by superposing and joining a second steel sheet as a vehicle body reinforcement member on a first steel sheet, a second step heating the superposed member, and a third step performing press forming and quenching the heated superposed member between the first die and the second die, in which the third step further including providing a hot press machine including a first refrigerant flow passage for guiding a refrigerant into the first die or the second die, a plurality of grooves formed in a press forming surface of the first die or the second die corresponding to a superposed portion of the superposed member, and a second refrigerant flow passage for guiding a refrigerant into the grooves, setting the heated superposed member on the first die in a state where the refrigerant flows through the first refrigerant flow passage, and pressing the superposed member between the first die and the second die and simultaneously bringing the refrigerant into direct contact with the superposed portion of the superposed member by letting the refrigerant flow through the grooves.

DETAILED DESCRIPTION OF THE INVENTION

Figure 1:
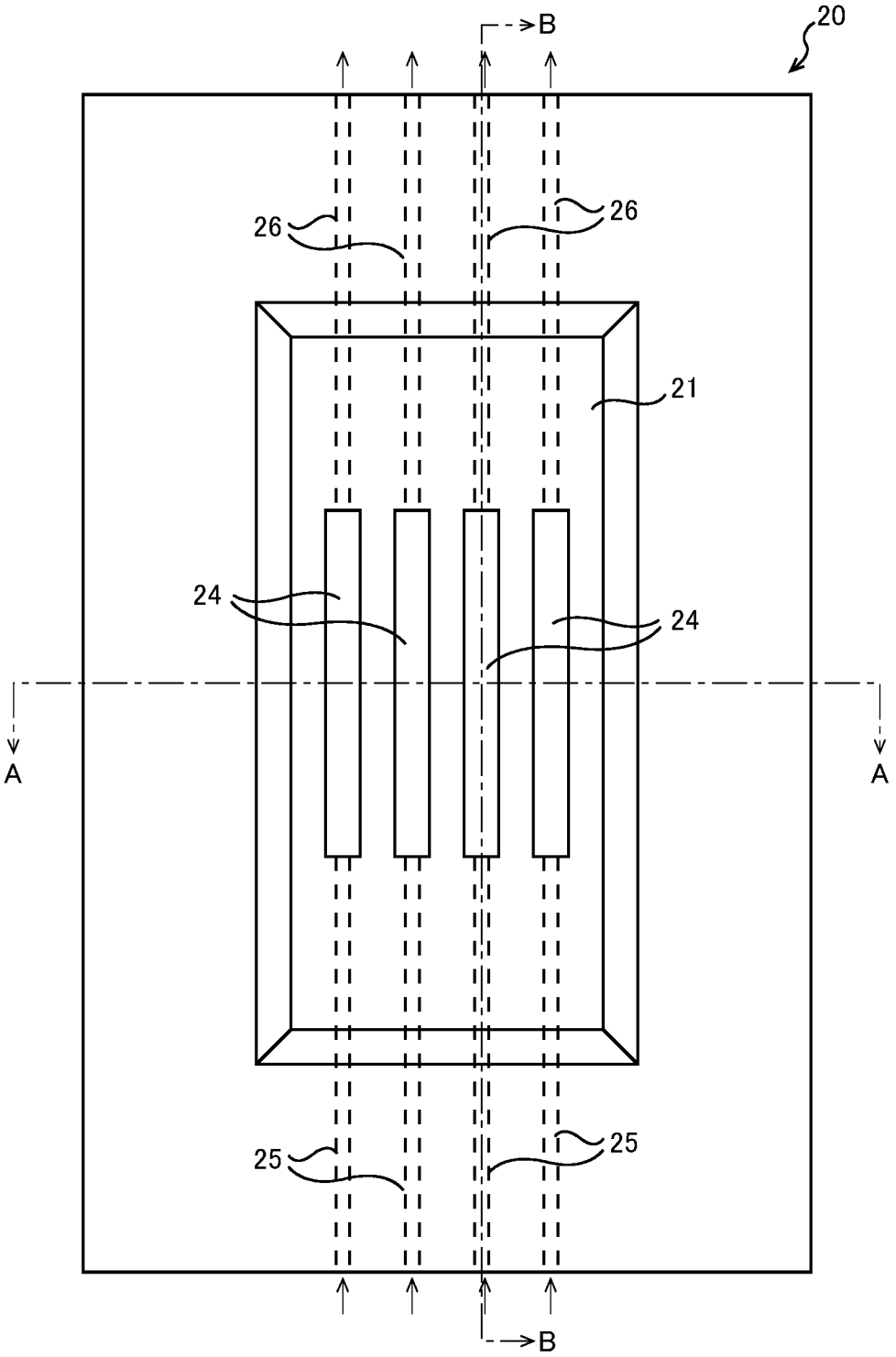
FIG. 1 is a plan view of an upper die of a hot press machine of a first embodiment of the invention.
Figure 2:
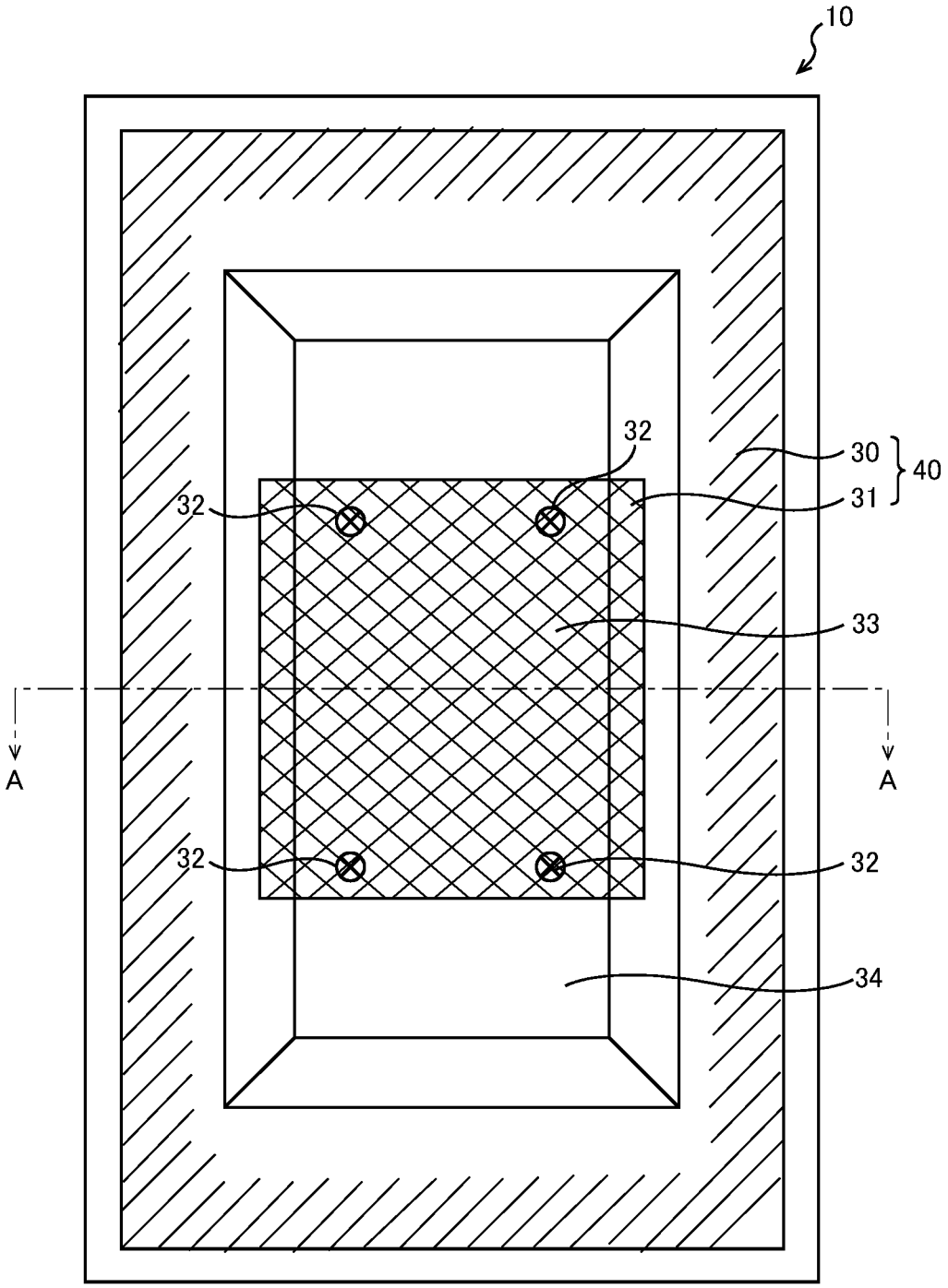
FIG. 2 is a plan view of a lower die of the hot press machine of the first embodiment of the invention.
Figure 3:
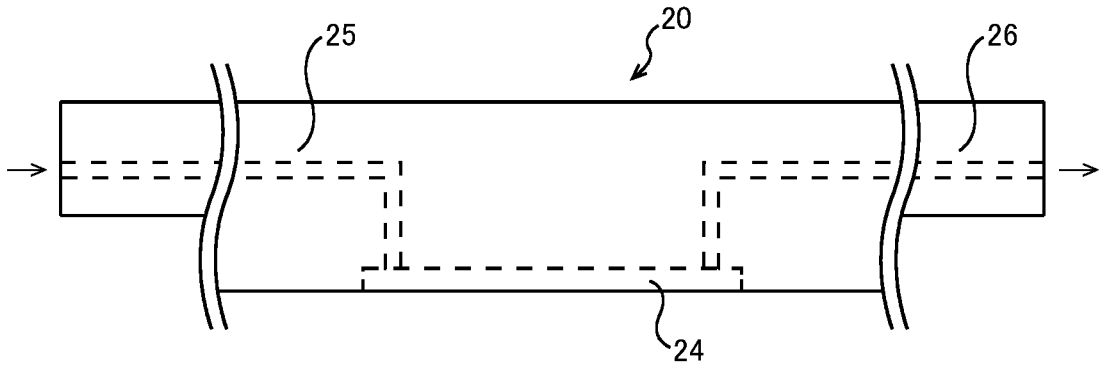
FIG. 3 is a cross-sectional view of the upper die of the hot press machine of the first embodiment of the invention.
Figure 4A:
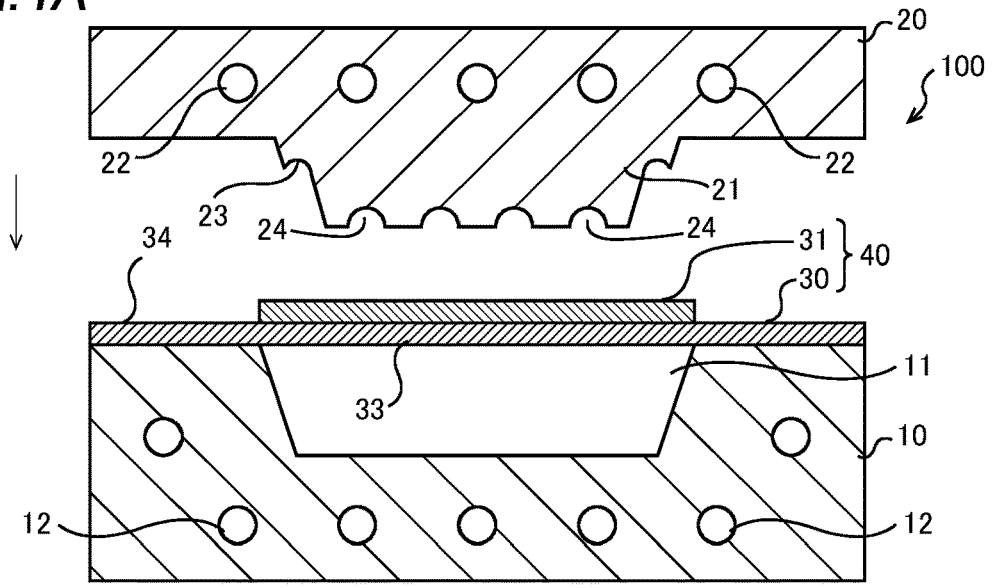
FIGS. 4A to 4C are cross-sectional views explaining the hot press machine and a hot press method of the first embodiment of the invention.
Figure 4B:
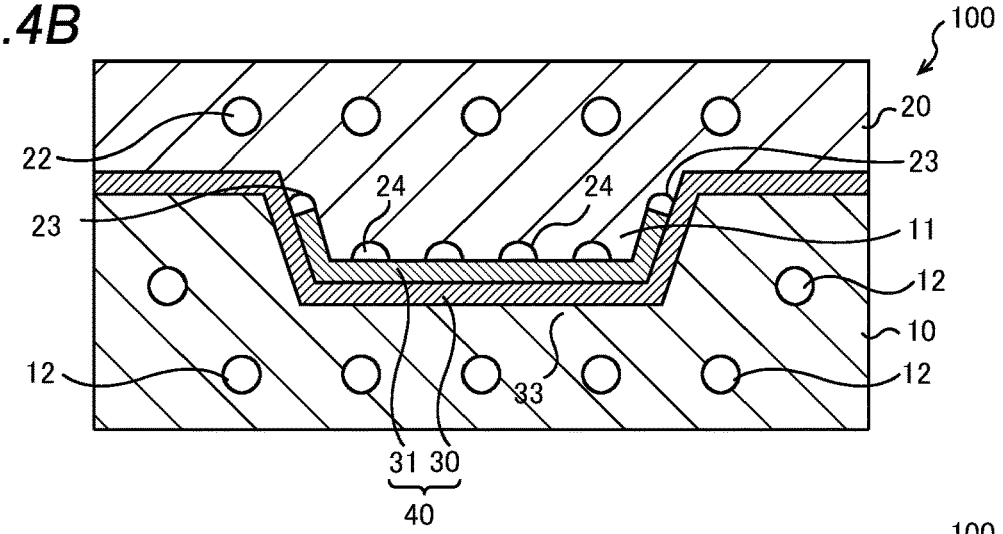
Figure 4C:
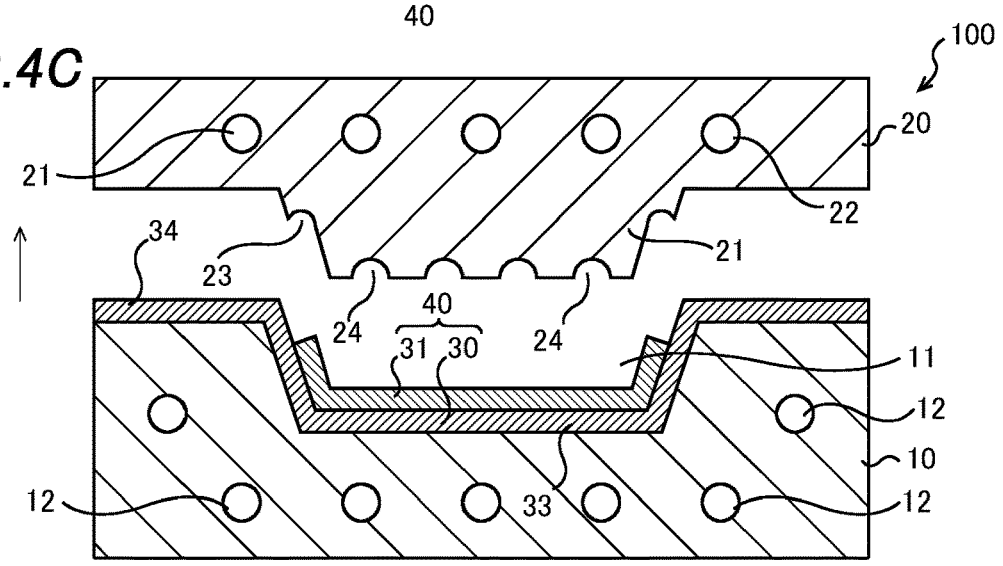

A hot press machine 100 of a first embodiment of the invention will be described referring to FIG. 1 to FIGS. 4A-4C. FIG. 1 is a plan view of an upper die 20 of the hot press machine 100 (a plan view from the press forming surface side). FIG. 2 is a plan view of a lower die 10 of the hot press machine 100 (a plan view from the press forming surface side), showing a state of a superposed member already set. FIG. 3 is a cross-sectional view along line B-B of FIG. 1. FIGS. 4A to 4C are cross-sectional views along line A-A of FIGS. 1 and 2, showing hot press steps in order of FIG. 4A, FIG. 4B and FIG. 4C.

As shown in the figures, the hot press machine 100 has the lower die 10 and the upper die 20 disposed above the lower die 10. The lower die 10 is fixed on a base (not shown), and the upper die 20 is disposed so as to face the lower die 10, which is configured to be moved in a vertical direction by a drive device (not shown).

A superposed member 40 has a first steel sheet 30 and a second steel sheet 31 superposed on the first steel sheet 30 and joined thereto at spot welding portions 32. When the superposed member 40 is a vehicle body component, the second steel sheet 31 is a vehicle body reinforcement member for enhancing the mechanical strength of the first steel sheet 30. The second steel sheet 31 is smaller than the first steel sheet 30, and the whole of the second steel sheet 31 is superposed on the first steel sheet 30 at a portion to be enhanced in its mechanical strength.

It is noted that in FIG. 2 the first steel sheet 30 is a rectangular plate having four edge portions indicated by the line shading. The middle portion of the first steel sheet 30 is made see-through so as to show the location of the concave portion 11 show in FIGS. 4A-4C. Hereafter, a portion where the first steel sheet 30 and the second steel sheet 31 are superposed is referred to as a superposed portion 33, and the other portion (a single portion of the first steel sheet 30 or the second steel sheet 31 only) is referred to as an unsuperposed portion 34.

The hot press machine 100 performs press forming and quenching by pressing the superposed member 40 between the lower die 10 and the upper die 20. In the embodiment, in order to form the superposed member 40 in a hat shape, a concave portion 11 is formed in the press forming surface of the lower die 10, a convex portion 21 is formed in the press forming surface of the upper die 20, and the convex portion 21 of the upper die 20 is to be engaged with the concave portion 11 of the lower die 10. However, both the press forming surfaces of the dies 10 and 20 are formed in any given shapes corresponding to product specification.

When the superposed member 40 is to be bended in a U shape in its crosssection, the lower die 10 has a pad portion supported by a spring so as to move in a vertical direction and a bending blade fixed adjacent to the pad portion, and is configured to press the superposed member 40 between the upper die 20 and the pad portion and bend it with the bending blade.

First refrigerant flow passages 12 and 22 for guiding a refrigerant into the lower die 10 and the upper die 20 so as to cool the lower die 10 and the upper die 20, respectively (e.g. refrigerant circulation pipes embedded in the dies) are formed in the lower die 10 and the upper die 20. A refrigerant such as cooling water flows through the refrigerant flow passages 12 and 22. Although the refrigerant flow passages 12 and 22 are respectively provided in the lower die 10 and the upper die 20 in the embodiment, it may be provided in only one of these dies 10 and 20.

A recess portion 23 is formed in the upper die 20, recessed away from the end surface of the second steel sheet 31 so as to prevent contact of the upper die 20 and the end portion of the second steel sheet 31 of the superposed member 40 in press forming. In the cross-sectional views of FIGS. 4A to 4C, the recess portion 23 is formed in the side surface of the convex portion 21.

A plurality of grooves 24 are further formed in the press forming surface of the upper die 20 (in the press forming surface of the convex portion 21 in the embodiment), corresponding to the superposed portion 33 of the superposed member 40. Although the shape of the crosssection of the grooves 24 is a semicircular shape in the embodiment, it may be any shape such as an elliptical shape, a quadrangular shape or a triangular shape.

Second refrigerant flow passages 25 and 26 for guiding a refrigerant such as cooling water into the grooves 24 is further provided in the upper die 20. As shown in FIGS. 1 and 3, each of the second refrigerant flow passages has a refrigerant flow-in passage 25 provided in the upper die 20 and guiding the refrigerant into the corresponding groove 24, and a refrigerant flow-out passage 26 provided in the upper die 20 and guiding the refrigerant out of the corresponding groove 24. The refrigerant flow-in passage 25 is connected to a bottom portion of one end of the groove 24 and the refrigerant flow-out passage 26 is connected to a bottom portion of the other end of the groove 24. The refrigerant flow-in passage 25 and the refrigerant flow-out passage 26 may include refrigerant flow pipes embedded in the upper die 20.

In this case, as shown in FIG. 1, it is preferable that the grooves 24 have the same depth, extend parallel in one direction to have a stripe form, and are arrayed at a predetermined pitch so as to prevent non-uniform cooling. For example, the depth of the grooves 24 is 5 mm, the width is 4 mm, and the pitch is 12 mm.

Next, a hot press method will be described referring to FIGS. 4A to 4C. First, as shown in FIG. 4A, in the state where the lower die 10 and the upper die 20 are open and a refrigerant flows through the first refrigerant flow passages 12 and 22 of the lower die 10 and the upper die 20, the superposed member 40 heated to a temperature at an austenite transformation point or higher (e.g. 900° C.) is set on the lower die 10. In the embodiment, the superposed portion 33 of the superposed member 40 is positioned on the concave portion 11 of the lower die 10.

Next, as shown in FIG. 4B, the upper die 20 is moved downward to a lower dead point, the superposed member 40 is press formed between the upper die 20 and the lower die 10, and simultaneously the superposed portion 33 of the superposed member 40 is cooled directly with a refrigerant by circulating the refrigerant through the grooves 24 (direct cooling).

In detail, when the upper die 20 is moved downward to the lower dead point, the convex portion 21 of the press forming surface of the upper die 20 presses the superposed member 40 into the concave portion 11 of the lower die 10 to form it. Since the recess portion 23 is formed in the upper die 20, the upper die 20 and the end portion of the second steel sheet 31 of the superposed member 40 are prevented from contacting. In detail, with the recess portion 23, the upper die 20 is spaced from the end portion of the second steel sheet 31 to form a space between the recess portion 23 and the end surface of the second steel sheet 31.

At this time, when the superposed member 40 and the press forming surface of the upper die 20 come into contact, the openings of the grooves 24 are closed by the second steel sheet 31 of the superposed portion 33 of the superposed member 40. The refrigerant then flows through the grooves 24 which are covered to form closed spaces. In detail, the refrigerant flows into one ends of the grooves 24 through the refrigerant flow-in passages 25, and the refrigerant which reaches the other end of the grooves 24 flows outside of the upper die 20 through the refrigerant flow-out passages 26.

At this time, the refrigerant such as cooling water flowing through the grooves 24 come into direct contact with the superposed portion 33 of the superposed member 40, and thus heat is exchanged between the refrigerant and the superposed portion 33 to enhance the cooling of the superposed portion 33 of the superposed member 40. While the unsuperposed portion 34 of the superposed member 40 is naturally cooled by the contact of the upper die 20 and the lower die 10, in addition to this, the superposed portion 33 is directly cooled by the contact of the refrigerant.

Then, as shown in FIG. 4C, when the temperature of the whole of the superposed member 40 lowers to a predetermined temperature (e.g. 200° C.) by keeping the state where the refrigerant flows through the grooves 24 for a predetermined time, the circulation of the refrigerant is stopped and the upper die 20 is moved upward toward an upper dead point to open both the dies 10 and 20.

Figure 7:
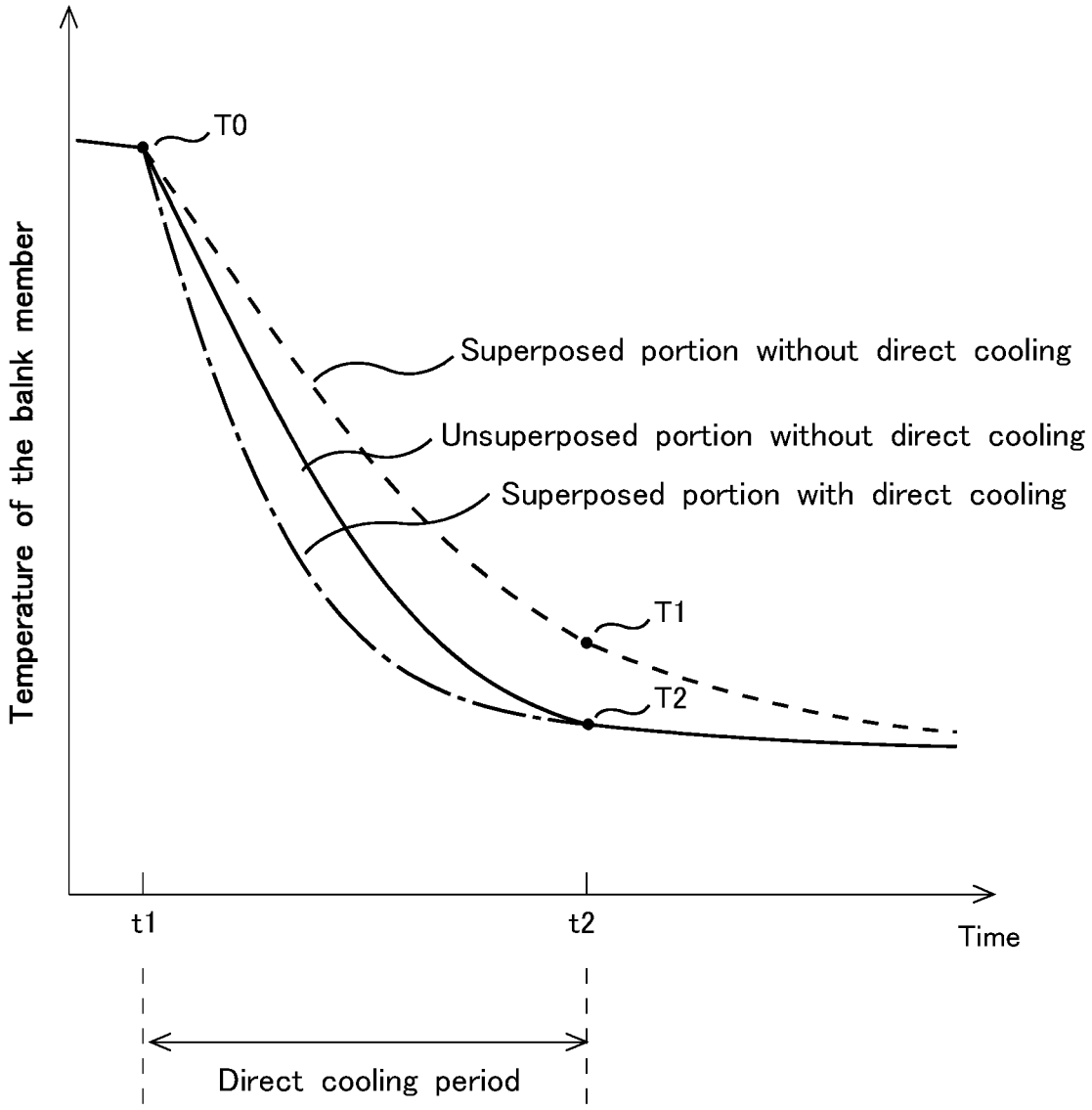
FIG. 7 is a graph showing the temperature changes of superposed members in hot press forming.

FIG. 7 is a graph showing the temperature change of the superposed member 40 in hot press forming. Prior to time t1, the superposed member 40 heated to a temperature T0 (e.g. 900° C.) is set in the hot press machine 100, and the temperature lowers slightly by natural cooling.

Then, the upper die 20 is moved downward to reach the lower dead point in tenths of a second and the superposed member 40 is press formed. A refrigerant flows through the grooves 24 at the time t1 when both the dies 10 and 20 are closed, thereby starting the direct cooling of the superposed portion 33 of the superposed member 40. Then, when the press forming is completed at time t2, i.e., when both the dies are open, the flow of the refrigerant through the grooves 24 is stopped, thereby ending the direct cooling.

As shown in FIG. 7, the temperature of the superposed portion 33 of the superposed member 40 lowers rapidly by the direct cooling. The temperature of the whole of the superposed member 40 (the superposed portion 33 and the unsuperposed portion 34) is thus set to be lowered to a target temperature T2 (e.g. 200° C.) at the time t2 (e.g. 5 seconds from the time t1). While the temperature of the superposed portion 33 lowers more rapidly than that of the unsuperposed portion 34 in FIG. 7, the cooling speed is controllable by controlling the flowing amount of the refrigerant or the number or pitch of the grooves 24.

Furthermore, in FIG. 7, while the period of direct cooling of the superposed member 40 corresponds to the period of press forming from t1 to t2, the cooling period may be reduced by stopping the flow of the refrigerant through the grooves 24 prior to the pressing ending time t2. In this case, the flow of the refrigerant through the grooves 24 is stopped in the state where the dies 10 and 20 are closed, until the temperature of the whole of the superposed member 40 (the superposed portion 33 and the unsuperposed portion 34) lowers to the target temperature T2. At the time when the temperature of the whole of the superposed member 40 lowers to the target temperature T2, the upper die 20 is moved upward to open both the dies 10 and 20.

On the other hand, in a conventional case (in a case of cooling with dies only, without the direct cooling of the superposed member 40), the temperature of the superposed portion 33 lowers relatively slowly, and corresponds to T1 which is higher than T2 (T1>T2) at the time t2. It takes more time (e.g. 5 to 10 seconds) to lower the temperature of the superposed portion 33 to T2, so that the completing of the hot press forming, i.e., the opening of both the dies 10 and 20 delays by that amount.

Therefore, when the thickness of the superposed portion 33 of the superposed member 40 is large, for example, 6 mm or more, it takes more time to cool it to cause incomplete quenching, thereby providing difficulty in completing the hot press forming itself. Furthermore, the non-uniform cooling of the superposed portion 33 and the unsuperposed portion 34 degrades the uniformity of the quenching quality, thereby degrading the size accuracy of the superposed member after hot press forming.

As described above, in the embodiment, the grooves 24 are provided in the press forming surface of the upper die 22 corresponding to the superposed portion 33 of the superposed member 40, a refrigerant flows through these grooves 24 in press forming, and the superposed portion 33 is cooled directly with the refrigerant, thereby enhancing the cooling of the superposed portion 33.

This realizes hot press forming even in a case where the thickness of the superposed portion 33 of the superposed member 40 is large, for example, 6 mm or more, in which hot press forming is impossible by indirect cooling with dies as conventionally used. Furthermore, by controlling the cooling speed of the superposed portion 33 so as to correspond to the cooling speed of the unsuperposed portion 34, the non-uniform cooling of the superposed member 40 is prevented, thereby enhancing the uniformity of the quenching quality and the size accuracy of the superposed member 40. Furthermore, the productivity is enhanced by reducing the cooling time of the superposed member 40.

Figure 5:
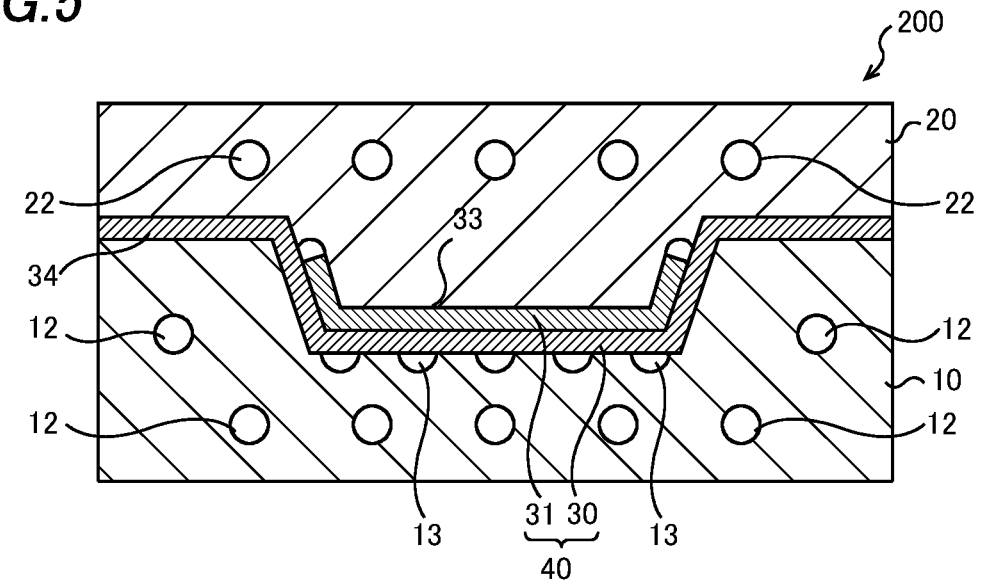
FIG. 5 is a cross-sectional view explaining a hot press machine and a hot press method of a second embodiment of the invention.

Next, a hot press machine 200 of a second embodiment of the invention will be described referring to FIG. 5. The hot press machine 200 differs from the hot press machine 100 of the first embodiment in that a plurality of grooves 13 are provided in the press forming surface of the lower die 10 and not in the upper die 20.

Along with this, the second refrigerant flow passages for guiding a refrigerant into the grooves 13 is provided in the lower die 10. Each of the second refrigerant flow passages has a refrigerant flow-in passages (similar to that shown in FIG. 3) provided in the lower die 10 and guiding the refrigerant into the corresponding groove 13 and a refrigerant flow-out passage (similar to that shown in FIG. 3) provided in the lower die 10 and guiding the refrigerant out of the corresponding groove 13. When the lower die 10 is configured so as to have a pad portion and a bending blade as described above, the grooves 13 are formed in the press forming surface of the pad portion.

The other structure is the same as that of the hot press machine 100 of the first embodiment, and the same effect is achieved. A hot press method using the hot press machine 200 is also the same as in the first embodiment, and the same effect is achieved. By the contact of the superposed member 40 and the press forming surface of the lower die 10 in press forming, the openings of the grooves 13 are covered by the first steel sheet 30 of the superposed portion 33 of the superposed member 40. At this timing, a refrigerant flows through the grooves 13 which are covered to form closed spaces.

Figure 6:
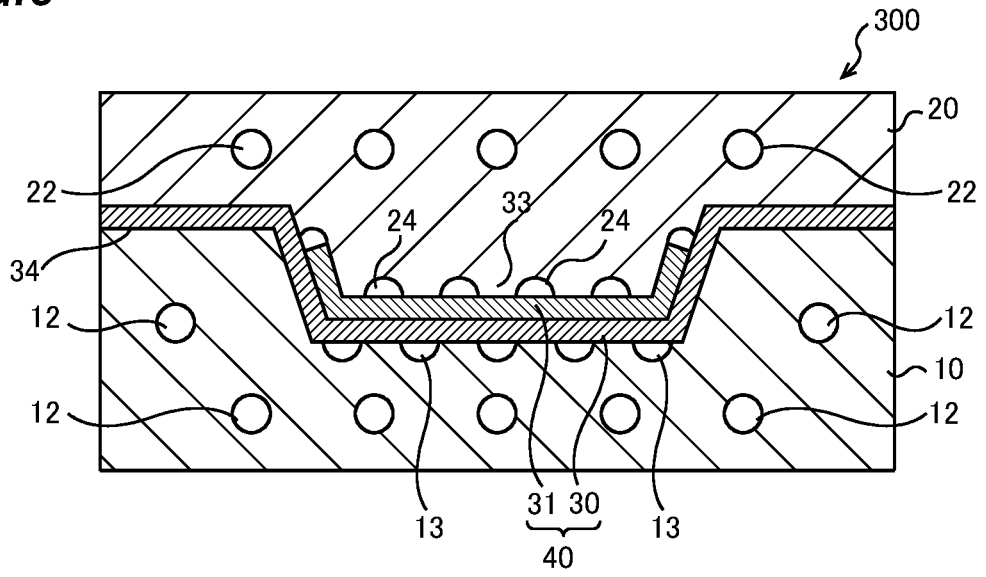
FIG. 6 is a cross-sectional view explaining a hot press machine and a hot press method of a third embodiment of the invention.

Next, a hot press machine 300 of a third embodiment of the invention will be described referring to FIG. 6. The hot press machine 300 differs from the hot press machine 100 of the first embodiment in that a plurality of grooves 13 and 24 are provided in the press forming surfaces of the lower die 10 and the upper die 20, respectively. In this case, it is preferable that the grooves 13 of the lower die 10 and the grooves 24 of the upper die 20 are disposed in shifted positions in a horizontal direction, respectively, so as not to overlap in a vertical direction.

Such a structure realizes the uniform cooling of the superposed member 40. The other structure is the same as that of the hot press machine 100 of the first embodiment. A hot press method using the hot press machine 300 is the same as in the first embodiment, too. In the embodiment, the grooves 13 and 24 are provided in both the press forming surfaces of the lower die 10 and the upper die 20 respectively, and therefore the cooling of the superposed member 40 is more enhanced than in the first and the second embodiments.

Although the superposed member 40 is formed of two steel sheets superposed on each other in the first to third embodiments, the invention is also applied to the hot press forming of the superposed member 40 formed of three or more steel sheets superposed on each other. The invention is preferably applied to manufacturing of a vehicle body component of a vehicle such as a pillar reinforcement which requires mechanical strength and high quality.

What is claimed is:

1. A hot press machine comprising:

a first die having a convex portion, a second die having a concave portion and is configured to be disposed on the first die so that the convex portion is in the concave portion, a first refrigerant flow passage for guiding a refrigerant into the first die or the second die, a plurality of grooves formed in a press forming surface of the first die or the second die; and a second refrigerant flow passage for guiding a refrigerant into the plurality of grooves, wherein the hot press machine is configured to perform press forming and quenching by pressing a superposed member between the first die and the second die, the superposed member comprising a first steel sheet and a second steel sheet superposed and joined on the first steel sheet, and the plurality of grooves are formed only on a top of the convex portion or a bottom of the concave portion.

2. The hot press machine of claim 1, wherein the plurality of grooves extend in parallel in one direction and arrayed at a predetermined pitch.

3. The hot press machine of claim 1, wherein the second refrigerant flow passage comprises a refrigerant flow-in passage provided in one of the first die and the second die and guiding the refrigerant into the plurality of grooves, and a refrigerant flow-out passage provided in the one of the first die and the second die and guiding the refrigerant out of the plurality of grooves.

4. The hot press machine of claim 1, wherein the plurality of grooves are formed in both of the press forming surfaces of the first die and the second die, and the grooves of the first die and the grooves of the second die are disposed in shifted positions in a horizontal direction so as not to overlap in a vertical direction.

5. A hot press method comprising:

a first step of forming a superposed member by superposing and joining a second steel sheet on a first steel sheet so that the superposed member comprises a superposed portion and a non-superposed portion;

a second step of heating the superposed member; and a third step of performing press forming and quenching by pressing the heated superposed member between a first die and a second die and bringing a refrigerant into direct contact with the superposed portion of the superposed member while not allowing the refrigerant to make direct contract with the non-superposed portion of the superposed member.

6. The hot press method of claim 5, wherein the third step comprises providing a hot press machine comprising a first refrigerant flow passage for guiding a refrigerant into the first die or the second die, a plurality of grooves formed in a press forming surface of the first die or the second die and corresponding to the superposed portion of the superposed member, and a second refrigerant flow passage for guiding a refrigerant into the plurality of grooves, and setting the heated superposed member on the first die in a state where the refrigerant flows through the first refrigerant flow passage, and pressing the superposed member between the first die and the second die and simultaneously bringing the refrigerant into direct contact with the superposed portion of the superposed member by letting the refrigerant flow through the plurality of grooves.

7. The hot press method of claim 6, further comprising stopping the flow of the refrigerant through the plurality of grooves and simultaneously opening the first die and the second die.

8. The hot press method of claim 6, further comprising opening the first die and the second die after stopping the flow of the refrigerant through the plurality of grooves.

9. A method of manufacturing a vehicle body component, the method comprising:

a first step of forming a superposed member by superposing and joining a second steel sheet as a vehicle body reinforcement member on a first steel sheet so that the superposed member comprises a superposed portion and a non-superposed portion;

a second step of heating the superposed member; and a third step of performing press forming and quenching the heated superposed member between a first die and a second die, wherein the third step further comprising providing a hot press machine comprising a first refrigerant flow passage for guiding a refrigerant in the first die or the second die, a plurality of grooves formed in a press forming surface of the first die or the second die and corresponding to a superposed portion of the superposed member, and a second refrigerant flow passage for guiding a refrigerant into the plurality of grooves, setting the heated superposed member on the first die in a state where the refrigerant flows through the first refrigerant flow passage, and pressing the superposed member between the first die and the second die and simultaneously bringing the refrigerant into direct contact with the superposed portion of the superposed member by letting the refrigerant flow through the plurality of grooves while not allowing the refrigerant to make direct contract with the non-superposed portion of the superposed member.

* * * * *